United States Patent [19]

Lienert

[11] Patent Number: 4,604,881

[45] Date of Patent: Aug. 12, 1986

[54] SHOT PEENING MACHINE

[75] Inventor: Gerold Lienert, Georgetown, Canada

[73] Assignee: Rockwell International Corporation, Pittsburgh, Pa.

[21] Appl. No.: 710,723

[22] Filed: Mar. 11, 1985

Related U.S. Application Data

[63] Continuation of Ser. No. 445,394, Nov. 30, 1982, abandoned.

[51] Int. Cl.[4] ..... B24C 1/10

[52] U.S. Cl. ..... 72/53; 51/418; 51/420; 29/90 A; 198/728

[58] Field of Search ..... 72/53; 51/417, 420, 51/410, 418; 29/90 A; 198/728, 733

[56] References Cited

U.S. PATENT DOCUMENTS

| | | | |
|---|---|---|---|
| 2,249,677 | 7/1941 | Wallace | 51/420 |
| 3,604,158 | 9/1971 | Daffron | 51/420 |
| 3,626,641 | 12/1971 | Powell et al. | 51/420 |

*Primary Examiner*—Francis S. Husar

*Assistant Examiner*—David B. Jones

[57] ABSTRACT

An improved shot peening machine is of the type which includes blast wheels capable of propelling a plurality of shot generally downwardly into a critical blast region of the machine for shot peening a plurality of springs passing therethrough. The improvement includes a housing for the machine including a blast cabinet, an entrance chamber and an exit chamber. The blast cabinet generally defines the critical blast region. Horizontally extending spinner rolls for the springs extend through the blast cabinet and terminate at a first end at a first edge of the critical blast region within the entrance chamber and a second end at a second edge of the critical blast region within the exit chamber. The springs are conveyed along a peening path on the spinner rolls from the first end to the second end thereof. A feeding system feeds the springs from an exterior of the housing into the entrance chamber to supply the springs to the first end of the spinner rolls. A discharge system discharges the springs from the exit chamber to the exterior of the housing as the springs are conveyed from the second end of the spinner rolls.

2 Claims, 5 Drawing Figures

SHOT PEENING MACHINE

This application is a continuation of application Ser. No. 445,394, filed 11/30/82, now abandoned.

BACKGROUND OF THE INVENTION

1. Field of the Invention

This invention relates to an improved shot peening machine and more particularly to such a shot peening machine in which there is provided a minimum number of components within a critical blast region thereof which components are subjected to wear and must be periodically replaced.

2. Description of the Prior Art

It is well known that the fatigue life of springs or similar types of work pieces that are subjected to repeated flexing stresses may be increased by cold working of the fibers at and near the surface of the metal by shot peening or blasting. For larger coil springs such as those used in automobile suspensions, it is not uncommon to provide a shot peening machine for conveying the springs through a fan-shaped shot stream with the springs being rotated about their axis for substantially uniform cold working of the entire surface.

A number of such shot peening machines have been heretofore successfully employed and include blast wheels and shot recirculation, fines separation and dust collecting systems which are well known to those skilled in the art. Although shown in a simplified form, U.S. Pat. No. 2,249,677 includes such a machine and, in one embodiment thereof, discloses a pair of spaced parallel spinner rolls which are mounted for rotation to support and rotate each spring being conveyed through the machine. Specifically, the springs are conveyed by a belt and finger arrangement which is located between the spinner rolls with each finger being capable of advancing an individual spring therethrough. A similar machine is shown in a simplified form in U. S. Pat. No. 2,341,674.

Still another prior art shot peening machine is shown in U.S. Pat. No. 3,383,803, which includes some discussion and explanation of the blast wheels and the shot recirculation system for returning shot to the blast wheels. The blast wheels provide the shot to an enclosed blast cabinet which is intended to contain all of the shot being used during the process. The prior art machine disclosed therein, however, utilizes a different means than discussed hereinabove for conveying and rotating a spring therethrough. This method is limited to coil springs which are formed with non-flattened ends. An elongated rotatable support roll extends continuously lengthwise through the machine and includes a plurality of annular ribs extending radially outwardly from the periphery of the roll. The ribs are axially spaced one from the other by a distance corresponding to the coil pitch of each coil spring to be supported thereon. Additionally, a pair of guide rollers are mounted for rotational movement about an axis parallel with the support roll but are spaced laterally one from the other and above the support roll. The space defined by the rolls is intended to loosely receive each coil spring therein. The guide rolls also extend continuously lengthwise through the machine and corresponding rotation of the guide rolls and the support roll cause rotation of the coil spring which results in it being conveyed through the machine as each coil spring is progressively advanced along the annular ribs of the support roll.

Still another prior art shot peening machine is disclosed in U.S. Pat. No. 3,604,158. This machine is also intended to rotate and convey cylindrical work pieces such as coil springs but utilizes a different conveying method than those described hereinabove. In order to provide for the transportation of each spring through the blast cabinet, a feed roll having a screw flight is mounted for rotation to progressively convey the springs through the machine. To maintain the springs in a spaced-apart relationship to insure that the shot can be directed to the ends thereof, the pitch of the screw is greater than the overall length of a spring. The spring is maintained in place on the feed roll by a pair of guide rolls which are mounted in a common horizontal plane slightly above the feed roll at a distance which is less than the spring diameter. Throughout the peening process, the guide rolls and feed roll are caused to rotate to impart a rotating motion to the springs to insure that the entire surface of each will be properly cold worked. In another embodiment disclosed in U.S. Pat. No. 3,604,158, a pair of fixed or rotating support rolls support a coil spring therebetween but axial movement of each spring is produced in a manner similar to those disclosed in the prior art devices mentioned hereinabove. Specifically, there is provided a plurality of fingers on a moving conveyor chain which is mounted between and below the support rolls. This embodiment still employs rotating guide rolls above and at opposite sides of the springs to produce rotation thereof as each spring is axially moved through the blast cabinet.

While each of the above described prior art shot peening machines appears to satisfactorily transport and rotate springs through a blast cabinet to insure proper shot peening of the entire surface of such springs, each of these machines includes features which cause them to be expensive to provide and costly to maintain. It has been found that any element located inside the blast cabinet in a critical blast region (a region in which shot which is provided by the blast wheels will still be traveling near to its maximum impact speed) is subjected to extensive wear. To increase the life of these elements, they are often manufactured of relatively expensive wear-resistant material, such as manganese steel alloy. Even though extensive manganese steel alloy protection plates and deflectors made of stock material may be provided to reduce and minimize this life-shortening damage to the various, more expensive, machined and manufactured components within the blast cabinet, they must nevertheless be periodically replaced and are just as expensive to replace as they were when initially provided.

Additionally, although the prior art shot peening machines discussed hereinabove appear to be primarily concerned with conveying and rotating coil springs through the critical blast regions of their respective shot peening machines, the particular components used for these purposes are also used to simultaneously feed the springs into the critical blast region and discharge the spring from the critical blast region. Accordingly, the various components required for the primary functions in the critical blast region must by necessity be sufficiently long to perform these additional functions. Any design requirement that would add to their overall length would tend to increase their initial cost and any future costs periodically required for their replacement.

SUMMARY OF THE INVENTION

It is therefor an object of this invention to provide an improved shot peening machine which is simple to provide and includes a minimum number of components within a critical blast region thereof which are subjected to extensive wear or damage requiring their periodic replacement.

These and other objects of the invention are provided in a preferred embodiment thereof including an improved shot peening machine of the type which includes blast wheel means or the like which is capable of propelling a plurality of shot generally downwardly into a critical blast region of the machine for shot peening a plurality of work pieces passing therethrough. The improvement includes a housing for the machine including a blast cabinet, an entrance chamber and an exit chamber. The blast cabinet generally defines the critical blast region. Horizontally extending support means for the work pieces extends through the blast cabinet and terminates at the first end at a first edge of the critical blast region within the entrance chamber and a second end at the second edge of the critical blast region within the exit chamber. There is provided means for conveying the work pieces along a peening path on the horizontally extending support means which peening path extends from the first end to the second end thereof. There is also provided means for feeding the work pieces from an exterior of the housing into the entrance chamber to feed the work pieces to the first end of the horizontally extending support means. There is included means for discharging the work pieces from the exit chamber to the exterior of the housing as the work pieces are conveyed by the means for conveying from the second end of the horizontally extending support means.

DETAILED DESCRIPTION OF THE PREFERRED EMBODIMENT

Figure 1A:
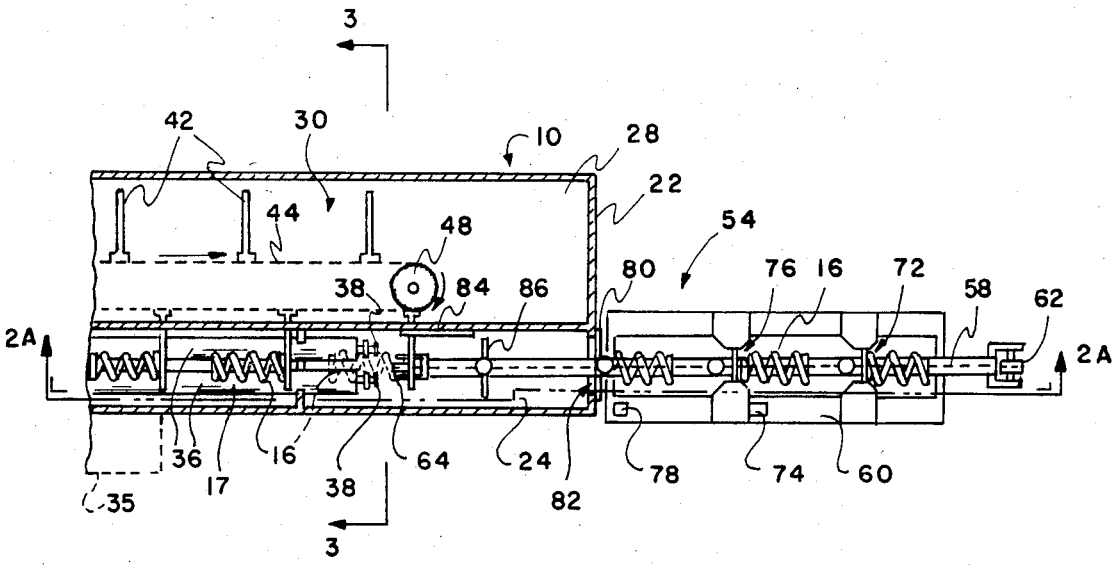
FIGS. 1A and 1B are a top view of the preferred shot peening machine with portions of the housing thereof removed and/or shown in phantom for a better view of various features of the invention.
Figure 2A:
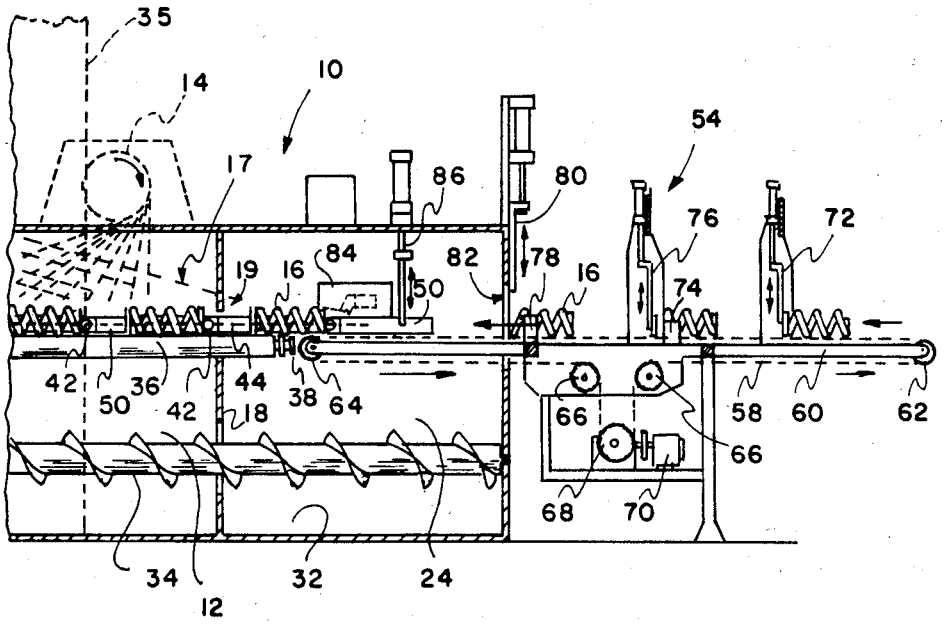
FIGS. 2A and 2B are a sectional elevation view of the preferred shot peening machine as seen generally along line 2—2 of FIGS. 1A and 1B.
Figure 1B:
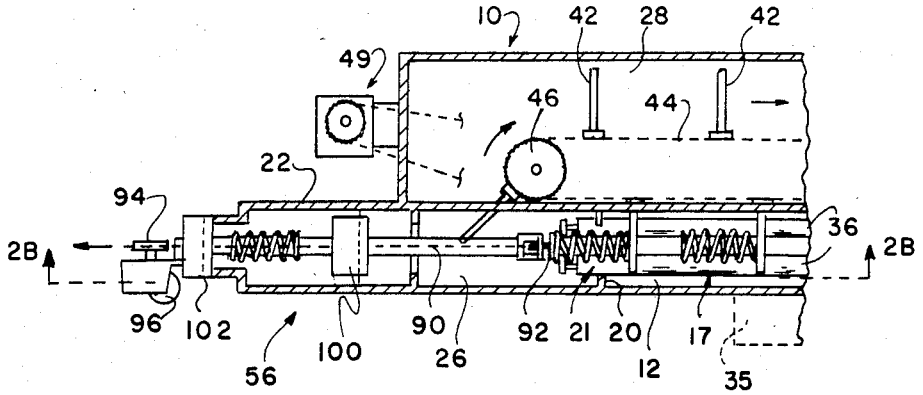
Figure 2B:
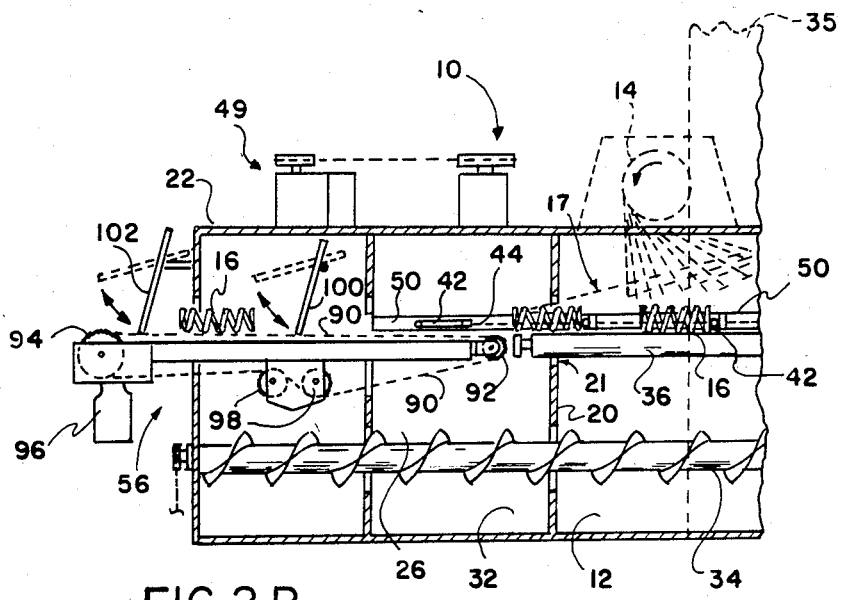
Figure 3:
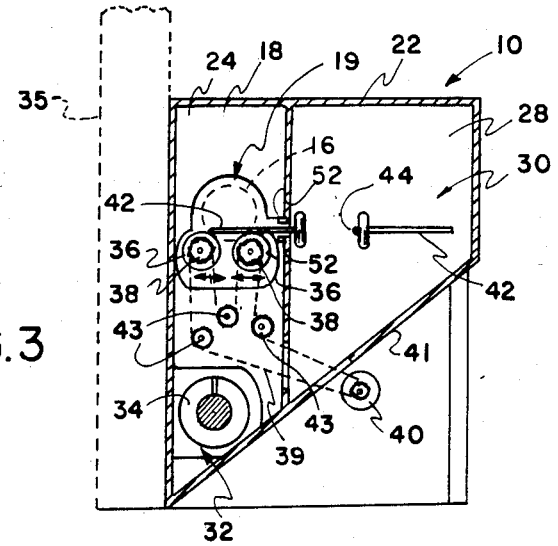
FIG. 3 is a sectional view of the preferred shot peening machine as seen along line 3—3 of FIG. 1A.

As seen in FIGS. 1A, 1B, 2A, 2B and 3, the preferred shot peening machine 10 includes a blast cabinet 12, the top of which supports a pair of blast wheels 14. The blast wheels 14 are capable of directing a plurality of shot generally downwardly under sufficent force for cold working work pieces such as springs 16. More specifically, the blast wheels 14 rotate in opposite directions to direct the shot to opposite ends of a spring 16 passing through the blast cabinet 12.

The top, bottom, sidewalls, and end walls 18, 20 of the blast cabinet 12 generally define the critical blast region 17 and are made of the wear resistant metal as described hereinabove. They only generally define the critical blast region 19 because of access holes 19, 21 respectively through walls 18, 20 which are needed to allow passage of the springs 16 into and through the blast cabinet 12. Some shot at working speed could travel a short distance through the holes 19, 21.

Since shot cannot be limited to the blast cabinet 12 below the blast wheels 14, the overall shot peening housing 22 is extended to include three other primary chambers thereof. An entrance chamber 24 is basically enclosed to prevent ricocheting and bouncing shot from escaping from the housing as the springs are being fed to the critical blast region 17. Similarly, an exit chamber 26 provides a region for retention of ricocheting and bouncing shot as the springs are being discharged from the primary blasting region. A back chamber 28 extends almost the entire length of the housing 22 and will be seen to enclose a conveying means 30 therein. It will be seen that the overall shot peening housing 22 is intended to retain all of the shot within the interior thereof. Even though the critical blast region 17 is the specific area designated for the desired cold working of the springs 16, there is no way of insuring that the shot will not escape the blast cabinet 12 and be propelled at a lower speed into the entrance chamber 24, exit chamber 26 or the back chamber 28.

In the base of the shot peening housing 22 is a trough 32 which extends the entire length thereof for the receipt and collection of spent shot and other solids removed from the surface of the coil springs 16. An auger 34 is provided therein and is mounted for rotation to deliver the spent shot and other solids to an elevator (not shown) within a housing 35. Such elevators are well known in prior art shot peening machines to be capable of delivering the material from the lower region of the shot peening housing 22 to a separator (not shown) above the blast wheels 14 for removal of undesired solids and the resupply of shot to the blast wheels 14.

It is essential in the transmission of the coil springs 16 through the blast cabinet 12 and the critical blast region 17 thereof, that the springs 16 be properly supported and caused to rotate to insure that the shot will be directed to all surfaces thereof. In the preferred shot peening machine 10, a pair of spinner rolls 36 are provided for this purpose. Specifically, the spinner rolls 36 are horizontally mounted with their axes parallel and slightly separating one from the other. As will be discussed hereinbelow, the space therebetween will depend upon the specific diameter of the coil springs 16 which are being peened. They clearly must be significantly closer than the overall diameter of the spring 16 to insure it will be properly supported between the spinner rolls 36. Depending on the size and shape of the springs to be peened, it may be desirable to include side rails or guides (not shown) which are horizontally above the spinner rolls 36 and extend the length of the critical blast region 17. The rails would not normally make contact with the springs 16 when properly positioned between the spinner rolls 36 but would insure that the springs 16 will not be dislocated by the shot or the rotation of the rolls 36.

The spinner rolls 36 are mounted for rotation at their exit end just inside the exit chamber 26 and are caused to be rotated by a common chain drive system at a pair of sprockets 38 at the entrance end thereof. Although not shown in FIGS. 1A, 1B, 2A or 2B to simplify the drawings, a chain 39 can be seen in FIG. 3 to be driven by a variable speed motor 40 which is mounted beneath shot peening housing 22 below the inclined wall 41 at the base of the back chamber 28. Idler sprockets 43 are provided within the entrace chamber 24 to direct the chain 39 to one sprocket 38, down to one of the another idler sprocket 43 and back up to the other sprocket 38 to prevent the chain 39 from interfering with each spring 16 as it is being fed to the spinner rolls 36. Although the sprockets 38, 43 and chain 39 are located in the entrance chamber 24 at the edge of the cirtical blast region 17, shielding (not shown) is provided to minimize the wear thereto that would be caused by stray shot in the entrance chamber 24.

As thus described, it can be seen that the spinner rolls 36 are provided an overall length which enables them to properly perform their primary function. The spinner rolls 36 can be seen to terminate at the edges of the critical blast region 17 and will only support the spring 16 and impart a rotating motion thereto when the springs 16 are in the critical blast region 17. As a result, the spinner rolls 36, which are cast of manganese steel alloy and are relatively expensive to provide, are designed to have a minimal overall expense. The spinner rolls 36 are not required in the preferred shot peening machine 10 to perform the additional functions of feeding the springs 16 to the critical blast region and discharging the springs therefrom.

Although the spinner rolls 36 will properly support and rotate the springs 16 in the critical blast region 17, a conveying means 30 must be provided to longitudinally convey each spring 16 therethrough. The preferred conveying means 30 includes a plurality of horizontally extending fingers 42 on a conveyor chain 44. The conveyor chain 44 is mounted to form a loop which extends horizontally in the back chamber 28 between a driven sprocket 46 and an idler sprocket 48. The sprockets 46, 48 are mounted with their axes extending vertically. The idler sprocket 48 is located prior to the entrance end of the spinner rolls 36 while the driven sprocket 40 is located rearwardly of the exit end of the spinner rolls 36. The driven sprocket 46 is caused to rotate by a variable speed motor and pulley configuration 49 mounted on the shot peening housing 22 so that it will not be in contact with or effected by any of the shot supplied to the critical blast region 17.

Specifically, as the chain 44 is caused to pass over the sprockets 46, 48, the plurality of fingers 42 which are spaced a predetermined distance apart will be extended into the entrance chamber 24 and passed horizontally through the blast cabinet 12 and into the exit chamber 26. A longitudinally extending slot 50 on the back wall of the entrance chamber 24, blast cabinet 12 and exit chamber 26 allows each finger 42 to extend laterally of the peening path from the back chamber 28 into the critical blast region 17 while being capable of passing above the spinner rolls 36 to convey each spring 16 longitudinally and horizontally therealong. Since the longitudinally extending slot 50 provides the only access for the fingers 42 to the critical blast region 17, any shot which could impinge on the chain 44 must pass through the slot 50 in order to enter the interior of the back chamber 28. To further minimize access to the slot 50, the preferred shot peening machine 10 is provided a pair of narrow, horizontally extending shelves 52 (FIG. 3) above and below the slot 50 to deflect the shot and prevent any direct impingement on the chain 44.

It can be seen that the preferred shot peening machine 10 includes a conveying system which is basically capable of conveying the springs 16 along the spinner rolls 36 in a manner which is different from methods disclosed in the prior art machines described hereinabove. By providing a different orientation for the fingers 42 and having them driven by a chain 44 which is capable of being located remotely from the critical blast region 17, no appreciable damage or wear should be experienced in the chain 44. Obviously, the fingers 42 would be subjected to direct impingement by the shot and would have to be made of wear-resistant metal. However, periodic replacement of the fingers 42 which are relatively simple to design and form would be significantly cheaper than the required replacement of the entire chain configuration which was, in some of the prior art machines, designed to pass through the critical blast region 17. The same comparison of cost could be made for the fingers 42 when compared to prior art configurations which used additional rolls in the critical blast region 17.

There is an additional advantage gained by the use of horizontally extending fingers 42. As seen in the prior art shot peening machines which incorporate chain driven fingers which extend vertically between spinner or support rolls, space must be provided for the fingers therebetween. With practical limits on the degree to which the space between the rolls could be reduced, any spring being peened therein must have a diameter which is sufficiently large to insure that it could be adequately supported by the rolls. However, in the preferred shot peening machine 10, there has been provided means for adjusting the spinner rolls 36 to decrease the space therebetween to accommodate coil springs with smaller diameters. In the machine 10, this adjustment (as indicated by the double-ended arrows in FIG. 3) is no longer limited by the size or width of any vertically extending fingers which were heretofore needed to convey the springs through the critical blast region.

Since the preferred shot peening machine 10 includes a configuration which requires a minimum number of components to be included in the critical blast region 17, it is necessary to provide a separating and feeding system 54 to supply the springs 16 to the interior of the machine 10 and a discharge system 56 to discharge the springs 16 after the peening operation is completed. While these two systems may initially appear to add to the overall cost and complexibility of the preferred shot peening machine 10, it should be kept in mind that the prior art machines described hereinabove by necessity utilized relatively expensive components to provide the same functions. Additionally, these components had to be periodically, entirely replaced because of the wear and damage which existed in the critical blast region 17. Therefore, even though there is some additional initial costs, the costs are relatively small and the components used in the separating and feeding system 54 and the discharge system 56 would not need to be made of the more expensive and durable material since they would not be subjected to shot in the critical blast region 17.

In order to provide automatic feeding for the preferred shot peening machine 10, the separating and feeding system 54 is aligned with the spinner rolls 36 to extend horizontally from the exterior of the shot peening housing 22 to terminate within the interior of the entrance chamber 24. Specifically, springs 16 are placed on the upper surface of a transmission roller chain or similar type of chain 58 with an upward portion thereof moving horizontally toward the spinner rolls 36. The chain 58 is mounted on a frame 60 and forms a loop in a vertical plane as it passes around a leading sprocket 62 and a trailing sprocket 64. The chain 58 is caused on its lower, return pass to be redirected over idler sprokets 66 to a driving sprocket 68 and motor drive 70 mounted below the frame 60. The surface of the chain 58 has sufficient frictional qualities to longitudinally move a spring 16 which is placed thereon. Side rails or guides (not shown) insure that the springs 16 are maintained in a longitudinal orientation and prevent them from rolling off of the upper surface of the chain 58. The speed of the motor drive 70 can be varied and, as will be discussed in detail hereinbelow, the feeding speed for the chain 58 can be selected according to the speed of the fingers 42. It is sufficient at this time to simply understand that the chain 58 will move horizontally faster than will the fingers 42.

Clearly, simply providing a horizontally, longitudinally moving chain 58 to supply springs 16 to the critical blasting region 17 would be inadequate since a means must be provided to insure that there is only one spring 16 in position as each finger 42 is extended into the entrance chamber 24 for conveying it through the critical blasting region 17. As a result, the separating and feeding system 54 is provided a plurality of gates to separate the springs 16 and to regulate the timing of their entrance to the interior of the machine 10. The gates will be seen to operate independently of the speed of the motor drive 70 and chain 58 even though the particular timing will be effected by the physical movement of the respective springs 16 along the upper surface of the chain 58.

To initially produce separation of a plurality of springs 16, a first gate 72 is normally open until a spring 16 which has passed therethrough is positioned at a first spring sensing device 74 which is located just prior to a second gate 76. The second gate 76 would also initially be in an open position so that a spring 16 passing through the first gate 72 might be sensed at the first spring sensing device 74 and continue on through the second gate 76. However, as the spring 16 passes through the first spring sensing device 74 a signal will be transmitted to close the first gate 72. The first gate 72 includes a vertically depending retarding finger which will prevent the next spring 16 from passing therethough. The retarding finger is elongated and has relatively small cross-sectional dimensions so that it is possible that the retarding finger of the first gate 72 might extend through the coils of a spring 16 positioned half way through the gate 72. Nevertheless, this still would retard the spring 16 in a manner which would be sufficient for its eventual supply to the subsequent gates. When the first gate 72 or the second gate 76 is closed, it should be understood that the springs 16 will simply be prevented from moving longitudinally with the upper surface of the chain 58 as the chain 58 continues to slide thereunder.

When a spring 16 has passed through the second gate 76, it will proceed to a second spring sensing device 78 located exterior of the housing 22. The second spring sensing device 78 will send a signal to close the second gate 76 and simultaneously open the first gate 72. Normally, a spring 16 initially arriving at the second spring sensing device 78 would be on the chain 58 traveling into the shot peening housing 22 but would be prevented from entering by a spring stop and shot sealing gate 80. The spring stop and shot sealing gate 80 includes sufficient cross-sectional dimensions to completely cover an access opening 82 to the housing 22 and the entrance chamber 24. As a result, the spring stop and shot sealing gate 80 will prevent undesirable escape of shot from the interior of the preferred shot peening machine 10 and would only be open sufficiently long to allow the passage of a spring 16 therethrough.

In order to determine when a spring 16 should be provided through the spring stop and shot sealing gate 80, a finger position sensing device 84 is provided in the interior of the entrance chamber 24 to determine when each finger 42 is passing thereby. Specifically, the preferred finger position sensing device 84 includes a camming element and a proximity switch (not shown) which will send a signal as each finger 42 is brought to a lateral position for conveying a spring 16 along the peening path through the critical blast region 17. When the finger position sensing device 84 is activated by a finger 42, the spring stop and shot sealing gate 80 receives a signal to open. Simultaneously, a secondary shot sealing gate 86 mounted within the entrance chamber 22 would be given a signal to close. The secondary shot sealing gate 86 is simply intended to insure deflection of shot from the access opening 82 during the short time that the spring stop and shot sealing gate 80 is in an open position. After a predetermined amount of time, which is preset in the control system and is predetermined according to the length of the springs 16 and the speed of the shot peening operation, the spring stop and shot sealing gate 80 will close, the secondary sealing gate 86 will open and the second gate 76 will open. Basically, this simultaneous operation is intended to allow a spring 16 being held at the spring stop and shot sealing gate 80 to pass completely through the openning 82 and then allow the gate 80 to close therebehind. The timing should be such that the secondary shot sealing gate 86 will be retracted prior to the spring 16 being longitudinally transmitted thereto. In other words, the secondary shot sealing gate 86 is not intended to and should not retard any of the springs 16 but simply serve as a barrier for the shot while the gate 80 is in an open position. As indicated, simultaneously, the second gate 76 will open to provide another spring 16 to the now closed spring stop and shot sealing gate 80 but will again be caused to close as soon as that spring 16 is positioned at the second spring sensing device 78. Once the spring 16 is at the second spring sensing device 78, as indicated hereinabove, the first gate 72 is then returned to its normal opened position and the spring 16 which had heretofore been retarded thereby would be released to be transported to the closed second gate 76. Again, the second gate 76 being in the closed position prevents further longitudinal movement of any spring 16 therethrough to establish the basic separation of the springs 16 as is needed to allow for the timed closure of the spring stop and shot sealing gate 80.

Clearly, as a finger 42 is brought to the finger position sensing device 84, the spring 16 being stopped and retarded by the gate 80 will be in no position to be transmitted along the peening path by that particular finger 42. However, as a particular finger 42 is at the finger position sensing device 84, it serves as a positive indication that the spring 16 previously supplied to the region at the entrance end of the spinner rolls 36 is being conveyed thereon for passage through the critical blasting region 17. Accordingly, the movement of each finger 42 by the sensing device 84 indicates that there is no longer a spring 16 at the trailing end of the chain 58 of the separating and feeding system 54 and a new spring 16 must then be supplied for the next proceeding finger 42. As indicated hereinabove, the horizontal speed of the chain 58 of the separating and feeding system 54 is by design to be greater than the speed of the fingers 42. Once the spring stop and shot sealing gate 80 is opened, the next spring 16 is rapidly transmitted to the end of the chain 58 at the sprocket 64 to be in a position for the next finger 42. Each spring 16 will extend at least partially onto the spinner rolls 36 under the frictional force of the chain 58. However, a spring 16 will not be fully positioned on the spinner rolls 36 or removed from the chain 58 sliding therebeneath until the next, appropriate finger 42 is properly, laterally positioned for conveying it into the critical blast regions 17.

It should now be clear that as long as there is provided a continuous supply of springs 16 to the first gate 72, the separating and feeding sytem 54 will automatically space and feed springs 16 to a position within the interior of the shot peening housing 22 as each finger 42 is in a position for its further conveyance through the critical blast region 17. The first gate 72 tends to initially retard each spring to insure that only one spring is positioned at the second gate 76. The second gate 76 tends to prevent any spring 16 from being provided to the spring stop and shot sealing gate 80 until a spring initially positioned there has been fully transported into the entrance chamber 24. Gate 80 will prevent a spring held thereby from entering the entrance chamber 24 until the finger position sensing device 84 indicates that the previously supplied spring 16 is now being moved horizontally onto the rolls 36. The spring stop and shot sealing gate 80 will then automatically close after the spring has passed completely therethrough and prior to the next spring being provided thereto. The secondary sealing gate 86 will only close to provide a secondary shot sealing means during the time that gate 80 is opened and will then be vertically retracted after a predetermined time which is sufficiently short to insure that no contact is made with a spring 16 passing therethrough. As a result, the spring 16 is capable of being positioned at the end of the chain 58 to be further transmitted by the next finger 42.

In the preferred separating and feeding system 54, each of the gates 72, 76, 80 and 86 are controlled by air operated cylinders. A control system (not shown) of a type which is well known in the machine control art is capable of actuation and deactuation of the cylinders according to various preplanned signals. Preferably, the spring sensing devices 74 and 78 are photocells but any number of other types of sensing devices might alternatively be utilized.

The discharge system 56 is provided to insure positive discharge of the springs 16 after they have passed through the critical blasting region 17. The discharge system 56 also includes a horizontally extending chain 90 which is aligned with the exit end of the spinner rolls 36. The chain 90 extends between a leading end sprocket 92 and a driven sprocket 94 which is driven by a fixed-speed motor 96.

The upper surface of the chain 90 moves in a direction for continued passage of each spring 16 from the exit chamber 26 to the exterior of the housing 22. On the return passage of the chain 90, it is caused to pass through a pair of adjustable idler sprockets 98 to provide proper tension for the chain 90. The speed of the chain 90 is preset to move much faster than the fingers 42. As a finger 42 has conveyed a spring 16 through the critical blast region 17, it continues to convey the spring off of the end of the spinner rolls 36 and onto the upper surface of the chain 90. Since the chain 90 is traveling at a higher rate, the spring 16 is propelled away from its finger 42 to provide sufficient space therebetween for the finger 42 to then be retracted from the exit chamber 26. In other words, each finger 42 will no longer be in contact with its spring 16 when that portion of the chain 44 on which it is supported is passing around the driven sprocket 46 and the finger 42 is being returned to the interior of the back chamber 28.

Again, to prevent inadvertent loss of shot which tends to ricochet within the interior of the housing 22, the discharge system 56 is provided a pair of gates 100 and 102. The gates 100 and 102 are both hinged gravity return shot sealing gates which are opened by the spring as it passes therethrough. After each spring 16 passes through the open gate 100, 102, the gate will automatically close to retard any shot which may have found its way into the exit chamber 26.

Having thus explained the overall operation of the preferred shot peening machine 10, it is appropriate to explain some of the versitility of the preferred shot peening machine and how it is basically operated to perform the shot peening operation on various springs. Initially, the operator must analyze the particular spring to be peened. If the spring has a small diameter, it is possible that the spinner rolls 36 must initially be adjusted to reduce the space therebetween to insure they will properly support and rotate the spring thereon. Further, the operator must determine how long the particular spring should be retained with the critical blast region 17. The length of time the spring should be retained within the critical blast region 17 will dictate the speed at which the conveyor chain 44 of the preferred conveying means 30 will be operated. Depending on the length of the spring, the fingers 42 may or may not be properly horizontally spaced. It should be kept in mind, that additional fingers 42 can be added to the chain 44 as long as the spacing between each finger 42 and its adjacent fingers 42 is identical. Generally, a spring must not be too close to the immediately preceding spring to insure that the ends of each spring are properly peened. In any case, the operator will realize that for a fixed rate through the critical blasting region 17, the overall number of springs to be peened can be increased if the distance between adjacent fingers 42 is kept to a minimum. While determining how long the spring will be retained in the critical blast region 17, a determination of its rotational speed will also be made to establish the speed setting for the motor 40 and the spinner rolls 36.

Once the speed of the chain 44 and the distance between the fingers 42 thereon is properly determined, the speed of the separating and feeding system 54 can be selected. As indicated hereinabove, the speed of the chain 58 thereof will definitely be faster than will be the speed of the conveyor chain 44. Regulation of the motor drive 70 of the separating and feeding system 54 will not directly effect the operation of the gates 72, 78, 80 and 86, since they will automatically be controlled by the various spring and finger sensing devices. However, the time delay after initiation of the finger position sensing device 84 will be separately regulated to insure free movement of the spring after it enters the entrance chamber 24. As mentioned hereinabove, the discharge system 56 is operated at a predetermined speed which is sufficiently great to insure removal of each opring throughout the range of speeds at which the conveying system 30 can be set.

Although the particular components to be found in the machine may vary by design according to the range of springs to be peened therein, there are certain features of the preferred shot peening machine 10 which should be described in order to provide a better understanding of its overall operations. For example, the springs which might be peened in the preferred shot peening machine 10 could have an outside diameter ranging from 2 $\frac{5}{8}$ inches to 11 $\frac{1}{2}$ inches. Springs of various shapes such as cylindrical, conical or barrel springs could all be satisfactorily peened in the machine 10. To insure proper cold working of this wide range of spring sizes and shapes, the preferred blast wheels are 2 $\frac{1}{2}$ inches wide with a 19 $\frac{1}{2}$ inch diameter and are driven by a 40 horse power motor mounted on top of the blast cabinet 12.

The critical blast region 17 would be approximately nine feet long. To properly control the springs within the critical blast region 17, as menitioned hereinabove, the spinner rolls 36 can be adjusted to vary the space therebetween to accommodate springs having any outside diameter within the range mentioned hereinabove while the speed of rotation can be adjusted to insure proper cold working of the particular spring being supported thereby. The variable speed drive for the conveying system 30 can be set to convey the fingers 42 at a speed of 9 to 27 feet per minute. The fingers 42 are approximately 15 inches long and made of $\frac{3}{4}$ inch diameter manganese steel alloy and are aligned to pass through the slot 50 which is approximately 1 inch wide. The chain 58 of the separating and feeding system 54 can be regulated to operate at a speed of 30 to 90 feet per minute. The fixed speed for the discharge system 56 is set at 130 feet per minute and, as indicated hereinabove is adequate for all settings for the conveying system 30.

As a general rule, the components described hereinabove are capable of accommodating springs at a production rate of between 240 and 720 springs per hour. Assuming a production rate of 600 springs per hour, each spring would be fed into, conveyed through, and discharged from the preferred shot peening machine 10 at a rate of 1 every 6 seconds.

It should be kept in mind that any number of alterations may be made to the preferred shot peening machine 10 without departing from the invention as claimed. For example, even though the blast cabinet of the preferred machine is fairly well defined; a different arrangement of walls and/or baffles could be provided to define an alternative blast cabinet which would generally define but not totally limit the critical blast region. Additionally, although the preferred shot peening machine is intended to shot peen a plurality of springs, other work pieces may be imployed in an alternative machine with various components within the machine being altered to accommodate such work pieces. For example, although the preferred horizontally extending support means for the work pieces is a pair of spinner rolls, if the work pieces were other than a spring, any number of types of horizontally extending support means could be utilized. However, since the horizontally extending support means is located in and limited to the critical blast region to keep its size to a minimum to reduce initial and replacement costs, such alternative machine would still require some means for feeding the work pieces into the housing and discharging the work pieces therefrom. Additionally, although the preferred means for conveying the springs 16 includes a finger and conveyor chain arrangement which is horizontally displaced from the critical blast region, it would be possible to include a conveying system which is located within the critical blast region. Although such an alternative conveying system would be subjected to significant wear and damage, the overall invention as claimed nevertheless includes features which recognize and provide for horizontally extending support means for the work pieces which are relatively inexpensive to initially provide and relatively inexpensive when they must be periodically replaced.

I claim:

1. An improved shot peening machine of the type which includes blast wheel means or the like which is capable of propelling a plurality of shot generally downwardly into a critical blast region of said machine for shot peening a plurality of springs passing therethrough, wherein said improvement comprises:

a housing for said machine including an entrance chamber, an exit chamber, and a blast cabinet therebetween;

said critical blast region being defined by a first edge thereof within said entrance chamber and a second edge thereof within said exit chamber and including the interior of said blast cabinet therebetween;

horizontally extending support means for said springs including a pair of spaced spinner rolls for supporting said springs therebetween, said spinner rolls extending through said blast cabinet and terminating at a first end at a first edge of said critical blast region within said entrance chamber and a second end at a second edge of said critical blast region within said exit chamber;

means for conveying said springs along a peening path on said spinner rolls which said peening path extends from said first end to said second end of said spinner rolls, said means for conveying said springs including a plurality of horizontally extending finger elements which extend transversely of said peening path above said spaced spinner rolls, each of said finger elements being capable of advancing one of said springs along said peening path through said critical blast region, said spinner rolls including a space therebetween free of any means for conveying so that said spaces can be varied without restriction between said spinner rolls to accommodate said springs within a range of different sizes and shapes, and said space can be preselected and fixed to accommodate said plurality of said springs having a particular size and shape, means for feeding said springs from an exterior of said housing into said entrance chamber to supply said springs to said first end of said spinner rolls; and means for discharging said springs from said exit chamber to said exterior of said housing as said springs are conveyed by said means for conveying from said second end of said spinner rolls, whereby said spinner rolls would be subject to wear from said plurality of shot in said critical blast region and require periodic replacement, said spinner rolls would have a minimum overall length needed to support said springs in said critical blast region, and said means for feeding and said means for discharging would be located out of said critical blast region and free of wear by said shot.

2. An improved shot peening machine of the type which includes blast wheel means or the like which is capable of propelling a plurality of shot generally downwardly into a critical blast region of said machine for shot peening a plurality of springs passing therethrough, wherein said improvement comprises:

a housing for said machine including a pair of spaced vertical walls defining an entrance chamber, an exit chamber and a critical blast region therebetween;

each of said walls being subject to said shot on the critical blast region side thereof;

one of said spaced vertical walls comprising the only barrier between said critical blast region and said entrance chamber;

the other said spaced vertical wall comprising the only barrier between said critical blast region and said exit chamber;

an access hole in each of said spaced vertical walls permitting passage of said springs;

a feed station adjacent said entrance chamber;

a discharge station adjacent said exit chamber, horizontally extending support means for said springs including a pair of spaced spinner rolls for supporting said springs therebetween, said spinner rolls extending through said critical blast region and terminating at a first end within said entrance chamber adjacent said access hole in said one vertical wall and terminating at a second end within aid exit chamber adjacent said access hole in said other vertical wall;

first conveying means for moving said springs along a peening path on said spinner rolls which said peening path extends from said first end to said second end of said spinner rolls;

second conveying means for moving said springs from said feed station into said entrance chamber to supply said springs to said first end of said spinner rolls adjacent said access hole in said one vertical wall; and third conveying means receiving said springs from said second end of said spinner rolls adjacent said access hole in said other vertical wall and moving said springs from said exit chamber to said discharge station;

said first, second and third conveying means being substantially axially aligned to provide continuous axial flow of said springs through said machine; and said pair of spaced vertical walls protect said second and third conveying means from said shot in said critical blast region;

whereby said spinner rolls and said first conveying means which require periodic replacement due to shot wear extend substantially only the axial extent of said critical blast region and, would be of minimum overall length.

* * * * *